United States Patent [19]

Corney

[11] 4,000,698

[45] Jan. 4, 1977

[54] SELF-SEPARATING SABOT

[75] Inventor: Martin Corney, Glendora, Calif.

[73] Assignee: General Dynamics Corporation Pomona Division, Pomona, Calif.

[22] Filed: Oct. 29, 1974

[21] Appl. No.: 518,689

[52] U.S. Cl. ..... 102/93
[51] Int. Cl.[2] ..... F42B 13/16
[58] Field of Search ..... 102/93

[56] References Cited

UNITED STATES PATENTS

| | | | |
|---|---|---|---|
| 3,005,408 | 10/1961 | Prosen et al. | 102/93 |
| 3,148,472 | 9/1964 | Hegge et al. | 102/93 X |
| 3,430,570 | 3/1969 | Barr | 102/93 |
| 3,496,869 | 2/1970 | Engel | 102/93 |
| 3,551,972 | 1/1971 | Engel | 102/93 X |
| 3,714,900 | 2/1973 | Feldmann | 102/93 |

*Primary Examiner*—Verlin R. Pendegrass
*Attorney, Agent, or Firm*—Henry M. Bissell; Edward B. Johnson

[57] ABSTRACT

A unique sabot for a sub-caliber or otherwise unusually configured projectile, the sabot being designed to have regions which, under the pressures automatically applied to one or more surfaces of the sabot during the launching of the projectile, fail, causing fracturing of the sabot and separation of the sabot pieces from the projectile within a short distance from the end of the launching device. Particular structure including a frangible sabot body with separation slots shaped to concentrate stresses in the body, and external pressure elements aligned with the slots are provided to achieve the desired end. Immediate break-up of the sabot at the end of the launching means, such as a gun barrel, assures a short area of danger from the sabot fragments in the launching area.

7 Claims, 9 Drawing Figures

SELF-SEPARATING SABOT

BACKGROUND OF THE INVENTION

1. Field of the Invention

This invention relates to sabots for projectiles and, more particularly, to such sabots which separate from a projectile immediately following the launching of the projectile.

2. Description of the Prior Art

Modern weapons require projectiles having very high velocities and penetrating power in order to be effective against high flying aircraft and against the thick armor plate of presentday tanks and ships.

In order to achieve this high velocity, it has been the practice to adapt sub-caliber projectiles so that they can be fired from a gun of larger caliber. This practice produces a greater penetrating power than is otherwise achieved. The subcaliber projectile, not being as heavy as the full diameter projectile, attains a greater velocity and smaller frontal area and thus can have a greater amount of kinetic energy at longer ranges. One method of adapting a projectile of a certain caliber for firing from a larger caliber weapon is to encase the projectile in a sabot which provides a gas seal as the projectile moves through the bore of the launching device, such as the barrel of a gun, and which disintegrates after it has emerged from the launching device.

Sabots may be used to adapt not only sub-caliber projectiles but, also, to adapt projectiles or payloads of odd configurations to a gun barrel or to a launcher tube.

In most operating situations, it is desired that the projectile being launched be separated from the sabot immediately after the sabot and the projectile have exited the gun barrel or launcher tube.

In many of the prior art sabots, the separation of the sabot from the projectile relied upon centrifugal forces produced as the combination of sabot and projectile was caused to rotate by the rifled internal surface of the gun barrel or launching tube. In other prior art devices, the separation of the projectile from the sabot depended upon aerodynamic drag upon the sabot, the sabot having been pre-grooved or cut. The air drag forces on the pre-grooved sabot caused it to separate from the projectile. Still other devices depend upon muzzle gas pressure or other forces on the sabot base or a combination of the forces mentioned to develop sabot separation after firing.

The limitation associated with those sabots which separate by reason of centrifugal forces was and is that the launching tube or barrel must have the appropriate rifling to produce the rotary motion of the sabot and projectile. Examples of sabots which separate by reason of centrifugal forces produced during launching of the sabot-projectile assembly are set forth in U.S. Pat. Nos. 2,992,612 of Critchfield et al, 2,998,779 of MacRoberts, 2,968,246 of H. F. Dunlap et al and 2,994,273 of Bleakney.

It is of course essential to achieve sabot separation in a manner which avoids applying asymmetrical forces to the projectile which would disturb its course to the target or otherwise adversely affect its performance. It is also desirable to achieve sabot breakup and separation uniformly and with predictability so that the sabot pieces themselves are not damaging in effect. None of the prior art known to applicant presents the capability of achieving the performance characteristics sought and achieved by applicant herein in his sabot-projectile assembly. Many of the sabot structures of the prior art had unpredictable, and often dangerous, performance characteristics.

Accordingly, it is a general object of the present invention to provide an improved self-separating sabot for use with projectiles.

It is a further object of the present invention to provide a self-separating sabot which assures improved performance of its associated projectile while, at the same time, assuring minimum cost and maximum safety to the user of the sabot-projectile assembly according to this invention.

SUMMARY OF THE INVENTION

In brief, arrangements in accordance with the present invention comprise a frangible sabot for a projectile of any configuration, the outermost dimensions of the sabot exceeding by a predetermined amount an established and related internal dimension of the barrel or launcher tube from which the projectile is to be launched. In one embodiment of the present invention, the sabot has internal grooves or separation slots disposed either longitudinally and/or circumferentially in the sabot and preferably tapered in configuration to concentrate the stresses at the apex of each groove or slot. On the outer surface of the sabot, aligned with the internal grooves or slots, may be pressure application regions or pressure pads which engage the walls of the gun barrel or launching tube. As a result, the pressures applied to one or more regions of the sabot as it and its associated projectile, or "payload", are forced along the gun barrel or launching tube cause stresses which are concentrated in stress lines along the sabot walls proximate to the apices of the internal grooves and those stresses cause fragmentation of the sabot along the stress lines. The sabot is broken into as many fragments as there are longitudinal and/or circumferential stress or failure lines. Because the sabot fragmentation process occurs as the sabot moves through the barrel, launching tube or other launching device, the sabot fragments fall away at the muzzle of the launching device and are carried only a limited distance beyond the muzzle.

This reduces potential injuries to the launching personnel. The self-separating sabot according to this invention will function in a rifled or smooth-bored gun barrel or launching tube because it does not rely upon centrifugal forces for separation, as did most of the prior art sabots. The size of the fragments can be controlled in both the longitudinal and circumferential directions by appropriately locating the separation slots and by relying upon pressure-produced stresses to cause the fragmentation, as is taught by this invention. The controlled fragmentation process of this invention wherein the sabot separates from the projectile immediately upon the emergence of the projectile from the muzzle of the launching device not only improves safety for the operators of the launcher but also permits actuation of means which signal the completion of the launch, a necessary function in the launching of projectiles incorporating fuse arming, for example.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENT

Figure 1:
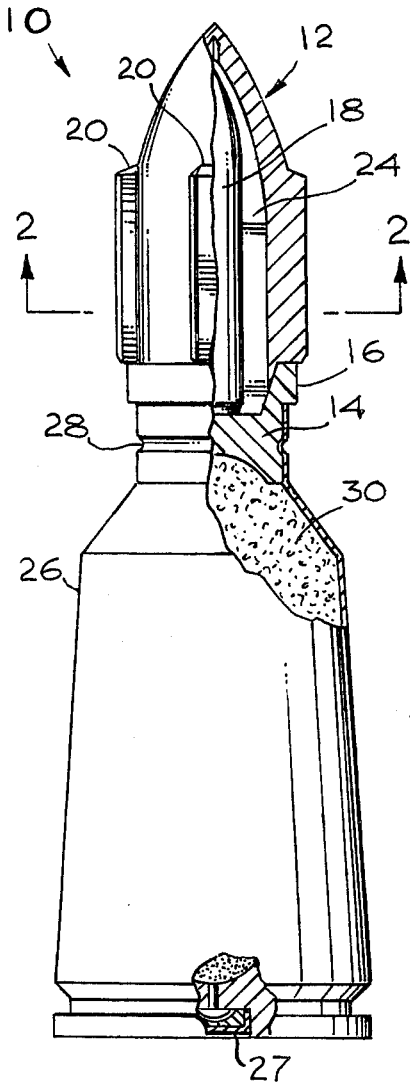
FIG. 1 is an elevation view, partially cut away, showing a sabot-projectile assembly according to the present invention.
Figure 2:
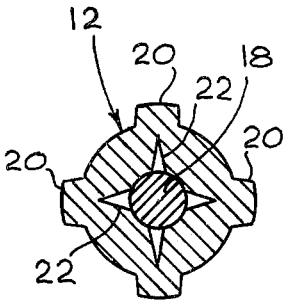
FIG. 2 is a cross-sectional view taken at line 2—2 in FIG. 1.

As shown in FIGS. 1 and 2, a sabot assembly 10 may include a frangible sabot body portion 12 and a sabot base plug or portion 14. The sabot base plug 14 may have, as a part thereof, a separate or integral circumferential rotating band 16. The sabot body 12 may be joined to the sabot base plug 14 by a threaded connection, a press fit, a force fit, notches, studs and grooves or adhesives. The sabot 10 encloses a projectile 18. The sabot body 12 may have a plurality of pressure application regions or pressure pads 20 formed or secured upon its outer surface. The sabot body 12 has a plurality of separation slots 22 formed in its inner surface 24 parallel to the axis of the sabot body 12, preferably, positioned beneath respective ones of the pressure pads 20. The separation slots 22 may have a triangular, square, U-shape or other shape to cause stress concentration in the region of the sabot body 12 proximate to the apices of such triangularly shaped slots to assure fracture lines of predetermined location when the sabot 10, including the projectile 18, is launched. The sabot base plug 14, carrying the sabot body 12 and the projectile 18, may be secured to a cartridge case 26 by means of a crimp and groove combination 28. An appropriate propellant 30 is included in the cartridge case 26, as is a primer 27.

Figure 3:
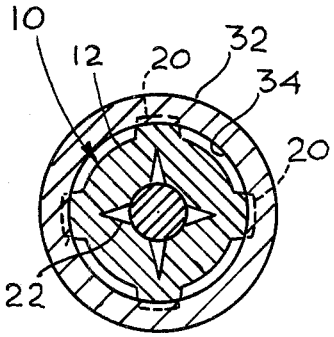
FIG. 3 is a cross-sectional view showing the sabot-projectile assembly of FIG. 1 in place in a gun barrel or launching tube.

In FIG. 3, the sabot assembly 10, including the sabot body 12 and the projectile 18, is shown in position for launching through a barrel or launching tube 32. As can be seen from FIG. 3, prior to activation of the propellant 30, the pressure pads 20 of the sabot body 12 extend slightly beyond the inner wall 34 of the barrel or launching tube 32. When the sabot assembly 10 is forced through the barrel 32, which has a smaller inside diameter than the diameter of a circle circumscribing the pressure pads 20, great pressure is exerted on the sabot body 12 and the stress thus produced is concentrated at the apices of the separation slots 22 with a consequent failure line being produced in the sabot body 12, causing that body to be broken into as many segments as are defined by the failure lines corresponding to the separation slots 22.

Although the inner surface 34 of the barrel or launching tube 32 has been shown in FIG. 3 as being smooth, it is to be understood that the inner surface 34 may be rifled so as to cause the sabot 10, including the projectile 18, to spin about its longitudinal axis when launched.

Figure 4:
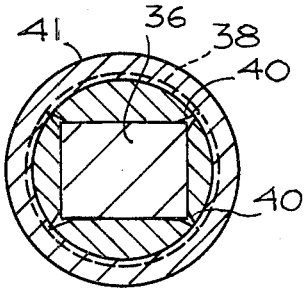
FIG. 4 is a cross-sectional view of a sabot and its associated payload in combination with a launching ring which can be effective to cause a separation of the sabot from the payload.

While in most cases it is true that the projectile to be launched is circular in cross section, it need not be. In such a situation the function of a sabot is to adapt the projectile of non-circular cross section to a launching device, whether it be a gun barrel, launching tube or launching ring of circular cross section or even of other non-circular cross-section. Such a use of a sabot is shown in FIG. 4 wherein a payload 36 is carried in a sabot 38 having a plurality of separation slots 40 therein. A pressure ring 41 is a portion of a launching device, not shown, and, as can be seen from FIG. 4, it has an inner diameter which is less than the outer diameter of the sabot 38. Of course, in place of the pressure ring 41 there may be the inner bore of a gun barrel or launching tube. As the sabot 38 carrying the payload 36 is forced through the pressure ring 41, he sabot 38 will fracture at lines corresponding to the apices of the separation slots 40.

Figure 5:
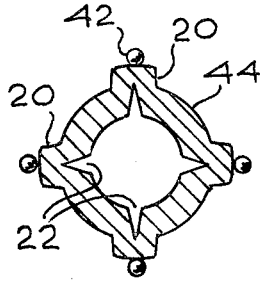
FIG. 5 is a diagrammatical representation of a frangible sabot according to the present invention in combination with pressure producing elements for causing the stresses which fracture the sabot.

In addition to the tubes and rings, the pressure necessary to produce the fragmentation of the sabot may be produced by means of other point, line or area contact pressure means such as balls, pins, rods, rollers and bars at one or more points into contact with which the sabot moves. Where one pressure point is used, a load bearing surface may be utilized to constrict movement of the sabot away from the pressure point, or the inertia forces inherent to a moving sabot assembly moving past a single projecting pressure point will insure contact and resulting pressure. In FIG. 5, a plurality of pressure devices 42, which may be balls or rods, are positioned to cooperate with the pressure pads 20 so as to cause fragmentation of the sabot 44 along lines corresponding to the apices of the separation slots 22. The remainder of the launching apparatus of which the rings or balls 42 are parts is not shown in FIG. 5. Where the pressure producing means, such as the balls or rods 42, do not form a continuous surface, proper orientation of the sabot 44 is necessary. Such orientation of the sabot 44 can be achieved by means of indexing notches, studs, magnets, conductive tape or radiation-emitting materials and such indexing means may be located on the sabot, projectile or cartridge case itself.

Figure 7:
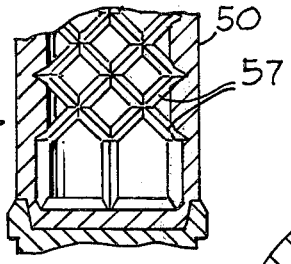
FIG. 7 is a sectional view of a portion of a sabot showing an alternative embodiment with the inner grooves oriented diagonally.
Figure 8:
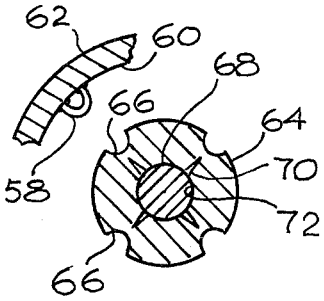
FIG. 8 is a diagram of an additional embodiment of the self-separating sabot according to the present invention.
Figure 6:
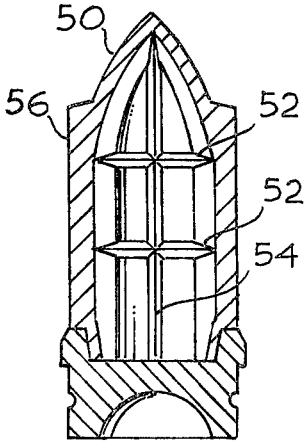
FIG. 6 is a sectional view of one embodiment of a sabot according to the present invention with the inner grooves oriented longitudinally and circumferentially.

The separation slots used to produce concentrations of mechanical stresses need not be parallel to the axis of the projectile and sabot. They may be circumferential in orientation or there may be a combination of a circumferential and longitudinal separation slots or slots at any angle with respect to the longitudinal axis. One such embodiment is set forth in FIG. 6, wherein a sabot 50 has a plurality of circumferential separation slots 52 therein. In addition, longitudinal separation slots, such as a slot 54, are provided. The sabot 50 has a plurality of pressure pads 56, corresponding to pressure pads 20 on sabot body 12 in FIG. 1. FIG. 7 illustrates a similar configuration in which the separation slots 57 are intersecting and are generally oriented diagonally, relative to the longitudinal axis of the sabot 50. The development of stresses to produce fragmentation of the sabot body in apparatus according to this invention may be achieved by means other than those set forth in connection with FIGS. 1 through 7. In FIG. 8, instead of pressure pads carried by the sabot body, a stud 58 is carried on an inner wall 60 of a barrel, launching tube or pressure ring 62. While a single stud is shown in FIG. 8, multiple studs, for example four in number, may be disposed about the inner wall 60. A sabot body 64 has a plurality of slots 66 designed and dimensioned to cooperate with the stud 58 and its related studs on the inner wall 60. The number of slots 66 should not be less than the number of the studs 58; however, the number of slots 66 may be more than the number of the studs 58. When the sabot body 64 carrying a projectile 68 moves through the barrel, tube or ring 62, each of the studs 58 exerts pressure upon the sabot body 64 in the region of a corresponding slot 66, producing stresses which cause the sabot body 64 to fracture in the region of each of the slots 66. If desired, additional separating slots, such as a slot 70 of triangular configuration, may be provided in the sabot body 64 along its inner wall 72 to assure fragmentation of the sabot body 64 along well defined, predetermined lines. The sabot body 64 must be properly oriented with respect to barrel, tube or ring 62 in order to assure engagement of each of the slots 66 by one of the studs 58. If the studs 58 extend for the length of the barrel, tube or ring 62, initial indexing of the sabot body 64 with its slots 66 engaging the studs 58 is a simple process. The other orientation methods which have been described hereinbefore may also be utilized.

Figure 9:
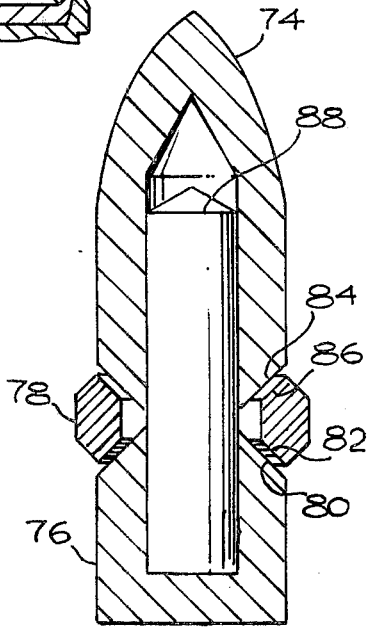
FIG. 9 is a further embodiment of a self-separating sabot relying upon pressure-produced stresses for its separation.

The concept of utilizing mechanical pressure on a sabot while the sabot is still within the barrel, launcher tube or pressure ring to produce internal stresses which effect automatic separation of the sabot from the projectile may take an additional form. In FIG. 9, a sabot body portion 74 is separated from a sabot base portion 76 by a sleeve or band 78 to which both the body 74 and the base 76 are secured, as by an adhesive. The pressure of the propellant on the sabot base portion 76 during the launching process causes mechanical pressure, upwardly directed in FIG. 9, to be applied to the band 78 through a sloped surface 80 on the sabot base 76 and a corresponding sloped surface 82 on band 78. Because of the initial inertia of rest of sabot body 74 and the frictional and other forces which sabot body 74 encounters in the launching device, a mechanical force, downwardly directed in the presentation of FIG. 9, is applied to the band 78 by reason of the contact between a sloped surface 84 of the sabot body 74 and a sloped surface 86 of the band 78. The oppositely directed mechanical forces experienced by the band 78 during the launching process are translated into tensile and other stresses within the band 78 by reason of the sloping relationship between the surface 84 and the surface 86 and between the surface 80 and the surface 82. This combination of stresses causes the band 78 to be fractured. Thus separation of the sabot body 74 and the sabot base 76 from a projectile 88 results. Sabot body 74 and sabot base 76 may have pre-cut radial cuts (not shown) to assist in separation from the projectile 88.

While energy to move the sabot assembly 10 is shown in FIG. 1 to be a chemical propellant, other energy sources known to practitioners of the engineering arts such as electrical energy, plasmas, magnetic force fields, springs, weights, compressed or heated gases, motors, water induced swelling, etc. can be utilized.

Although there have been described herein a number of embodiments of a self-separating sabot in accordance with this invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A self-separating sabot for use in launching a projectile from launching means, including:

a base portion;

a frangible sabot body enclosing said projectile and secured to said base portion, said sabot body having a longitudinal axis therein; and mechanical application pressure means projecting from the outer surface of said sabot body, said frangible sabot body being responsive to said mechanical application pressure means to generate fracturing stresses within said sabot body.

2. Apparatus according to claim 1 further including a plurality of separation slots in the sabot body.

3. Apparatus according to claim 2 in which the separation slots are directed generally parallel to the longitudinal axis of the sabot body.

4. Apparatus according to claim 2 in which said separation slots are along an internal surface of said sabot body.

5. A self-separating sabot for use in launching a projectile from launching means, including:

a base portion;

a frangible sabot body enclosing said projectile and secured to said base portion, said sabot body having a longitudinal axis therein, said sabot body further having a plurality of separation slots formed in the inner surface of said sabot body; and a plurality of pressure application pads projecting from the outer surface of said sabot body, said pressure application pads substantially in register with said separation slots, said frangible sabot body being responsive to said pressure application pads to generate fracturing stresses within said sabot body.

6. Apparatus according to claim 5 wherein said separation slots are substantially parallel to said longitudinal axis of said sabot body.

7. Apparatus according to claim 5 wherein said separation slots are along an internal surface of said sabot body.

* * * * *